US008550738B2

(12) United States Patent
Thorpe et al.

(10) Patent No.: US 8,550,738 B2
(45) Date of Patent: Oct. 8, 2013

(54) FLOW-THROUGH DISPENSER WITH HELICAL ACTUATION

(75) Inventors: Timothy Thorpe, Santa Monica, CA (US); Luis Alviar, Salem, OR (US)

(73) Assignee: HCT Asia Ltd, Central (HK)

( * ) Notice: Subject to any disclaimer, the term of this patent is extended or adjusted under 35 U.S.C. 154(b) by 1200 days.

(21) Appl. No.: 12/200,708

(22) Filed: Aug. 28, 2008

(65) Prior Publication Data

US 2010/0054844 A1 Mar. 4, 2010

(51) Int. Cl.
*A46B 11/04* (2006.01)
*A47L 13/22* (2006.01)

(52) U.S. Cl.
USPC ..... 401/270; 401/116; 401/280; 401/282; 401/286

(58) Field of Classification Search
USPC ..... 401/75, 77–79, 116, 286, 289–291, 401/270, 274, 280–282
See application file for complete search history.

(56) References Cited

U.S. PATENT DOCUMENTS

| | | | |
|---|---|---|---|
| 1,065,879 | A | 6/1913 | Krebs |
| 1,112,193 | A | 9/1914 | Carleton |
| 1,182,235 | A | 5/1916 | Amrock |
| 1,188,214 | A | 6/1916 | Sohn |
| 1,355,026 | A | 10/1920 | Austin |
| 1,358,597 | A | 11/1920 | Tobias |
| 1,365,246 | A | 1/1921 | Kendall |
| 1,506,292 | A | 8/1924 | Corsello |
| 1,626,992 | A | 5/1927 | Willk |
| 2,990,086 | A | 6/1961 | Williams |
| 3,729,011 | A | 4/1973 | Gleicher |
| 3,850,183 | A | 11/1974 | Gruska |
| 4,224,958 | A | 9/1980 | Kaplan et al. |
| 4,674,537 | A | 6/1987 | Bergmann |
| 4,906,120 | A | 3/1990 | Sekiguchi et al. |
| 6,142,695 | A | 11/2000 | Byun |
| 6,363,948 | B2 | 4/2002 | Choi |
| 6,418,939 | B1 | 7/2002 | Byun |
| 6,793,431 | B1 | 9/2004 | Tsai |
| 6,935,802 | B1 | 8/2005 | Byun |
| 7,101,107 | B1 | 9/2006 | Byun |
| 7,234,474 | B2 | 6/2007 | Byun |

(Continued)

FOREIGN PATENT DOCUMENTS

| | | | |
|---|---|---|---|
| CN | 1736816 | A | 2/2006 |
| CN | 2866193 | Y | 2/2007 |

(Continued)

OTHER PUBLICATIONS

Final Office Action for U.S. Appl. No. 12/267,486, mailed on Oct. 28, 2011, Timothy Thorpe, "Dispenser With a Flow-Through Compressible Gasket", 9 pages.

(Continued)

*Primary Examiner* — Tuan N Nguyen
(74) *Attorney, Agent, or Firm* — Lee & Hayes, PLLC

(57) ABSTRACT

A dispenser includes a flow-through gasket and a lower valve having a reservoir for containing a product. The flow-through gasket has at least aperture to provide a product delivery passage when the dispenser is selectively rotatable along a helical guide slot to a raised position. When the dispenser is selectively rotatable along the helical guide slot to a retracted position, the dispenser is in a stored state. In some examples, the flow-through gasket may be made of a material having elastomeric properties.

26 Claims, 8 Drawing Sheets

(56) References Cited

U.S. PATENT DOCUMENTS

| | | | | |
|---|---|---|---|---|
| 7,237,973 | B1 | 7/2007 | Lou | |
| 7,344,327 | B2 | 3/2008 | Gueret | |
| D598,655 | S | 8/2009 | Thorpe et al. | |
| 7,775,737 | B2 * | 8/2010 | Deans et al. | 401/281 |
| 7,794,168 | B2 | 9/2010 | Chang | |
| 2003/0024545 | A1 | 2/2003 | Delage | |
| 2004/0089318 | A1 | 5/2004 | Tahara | |
| 2004/0120753 | A1 | 6/2004 | Gieux | |
| 2004/0250833 | A1 | 12/2004 | Jang | |
| 2006/0278665 | A1 | 12/2006 | Bennett | |
| 2007/0098485 | A1 | 5/2007 | Byun | |
| 2007/0158372 | A1 | 7/2007 | Kurek et al. | |
| 2008/0264440 | A1 | 10/2008 | Thorpe | |

FOREIGN PATENT DOCUMENTS

| | | | |
|---|---|---|---|
| CN | 201131422 | Y | 10/2008 |
| GB | 798044 | A | 7/1958 |
| GB | 2404370 | A | 2/2005 |
| GB | 2446039 | A | 7/2008 |
| JP | 9056462 | A | 3/1997 |
| JP | 3051335 | U | 6/1998 |
| JP | 2004222853 | A | 8/2004 |
| JP | 2005121103 | A | 5/2005 |
| JP | 2008309807 | A | 5/2010 |
| WO | WO2006101339 | A1 | 9/2006 |

OTHER PUBLICATIONS

Office action for U.S. Appl. No. 12/267,486, mailed on Jun. 15, 2011, Thorpe et al., "Dispenser With a Flow-Through Compressible Gasket".

CN 3203451, Registered Industrial Design Application (Tianjin Samsung Brushes Ltd.) Oct. 10, 2001.

CN 3401674, Registered Industial Design Application (Tianhin Samsung Brushes Ltd.), Nov. 3, 2004.

Chinese Office Action mailed Dec. 5, 2011 for Chinese patent application No. 200810174317.1, a counterpart foreign application of US patent No. 8,047,214, 8 pages.

International Search Report from Application No. GB0900737.8, mailed on May 21, 2009, 7 pages.

Search Report from Patents Directorate, South Wales, for Application No. GB0817901.2, mailed Feb. 12, 2009, 5 pages.

Search Report from Patents Directorate, South Wales, for Application No. GB0817902.0, mailed Feb. 5, 2009, 8 pages.

Translated Chinese Office Action mailed Mar. 31, 2012 for Chinese patent application No. 200810183968.7, a counterpart foreign application of U.S. Appl. No. 12/267,486, 1 page.

Chinese Office Action mailed Mar. 30, 2012 for Chinese patent application No. 200810173142.2, a counterpart foreign application of U.S. Appl. No. 12/200,708, 5 pages.

Translated Chinese Office Action mailed May 9, 2012 for Chinese patent application No. 200910003314.6, a counterpart foreign application of US patent No. 7,955,014, 5 pages.

Translated Chinese Office Action mailed Jun. 6, 2012 for Chinese patent application No. 200810174317.1, a counterpart foreign application of US patent No. 8,047,214, 10 pages.

Translated Chinese Office Action mailed May 10, 2013 for Chinese patent application No. 200810173142.2, a counterpart foreign application of U.S. Appl. No. 12/200,708, 14 pages.

Japanese Office Action mailed May 10, 2013 for Japanese patent application No. 2008-309807, a counterpart foreign application of U.S. Appl. No. 12/267,486, 8 pages.

* cited by examiner

FLOW-THROUGH DISPENSER WITH HELICAL ACTUATION

BACKGROUND

Devices exist for dispensing cosmetic, medicinal, food, household, or other type products. Such devices usually consist of an outer housing, a delivery mechanism for dispensing the different types of products, and an applicator. For example, in various industries, devices are employed for applying powder, gel, creams, or lotions. In the cosmetics and personal care industries, devices are used to apply lipstick, lip balm, skin creams, lotions, compact powder, loose powder, and other cosmetic products to portions of the face and body.

Typically, these devices have many drawbacks. For example, the product may not be dispensed at a controlled rate, allowing either too little or too much to come out of the device. Another problem is that an applicator on the device may allow product to continue to flow out of the device, once the desired amount of product has been dispensed. For example, the product may leak or spill out of the device, especially when travelling from one location to another for reapplication during the day, resulting in a wasted amount of product and a mess for the user. Accordingly, there remains a need in the art for improved devices.

SUMMARY

This summary is provided to introduce simplified concepts of flow-through gaskets in dispensers, which are further described below in the Detailed Description. This summary is not intended to identify essential features of the claimed subject matter, nor is it intended for use in determining the scope of the claimed subject matter.

This disclosure is directed to dispensers having a flow-through gasket with at least one aperture that are rotatable in a spiral motion. This disclosure describes a dispenser including an upper valve, the flow-through gasket, and a lower valve with a reservoir for containing a product. The assembly of the upper valve, the flow-through gasket, and the lower valve being selectively rotatable in a spiral motion or a helical actuation to an upward position for the dispenser to deliver the product and to a downward position to store the dispenser. Furthermore, the dispenser includes an applicator for applying the product.

This disclosure is directed to another implementation of a dispenser with a helical guide slot and an L-shaped guide slot. The dispenser includes an assembly with a lower valve with a reservoir for containing a product, a flow-through gasket, and an upper valve. The assembly of the three components is selectively rotatable to an upward position, as a user moves a mechanism, such as a collar connected to guide pins located on the lower valve and the upper valve. The assembly moves along the helical guide slot in order to rotate to the upward position of the helical guide slot and simultaneously into the L-shaped guide slot to deliver product. Also, the assembly is selectively rotatable to a downward position, as the user moves the guide pin along the helical guide slot to the downward position to store the dispenser.

The features, functions, and advantages that have been discussed above or will be discussed below can be achieved independently in various implementations, or may be combined in yet other implementations, further details of which can be seen with reference to the following description and drawings.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
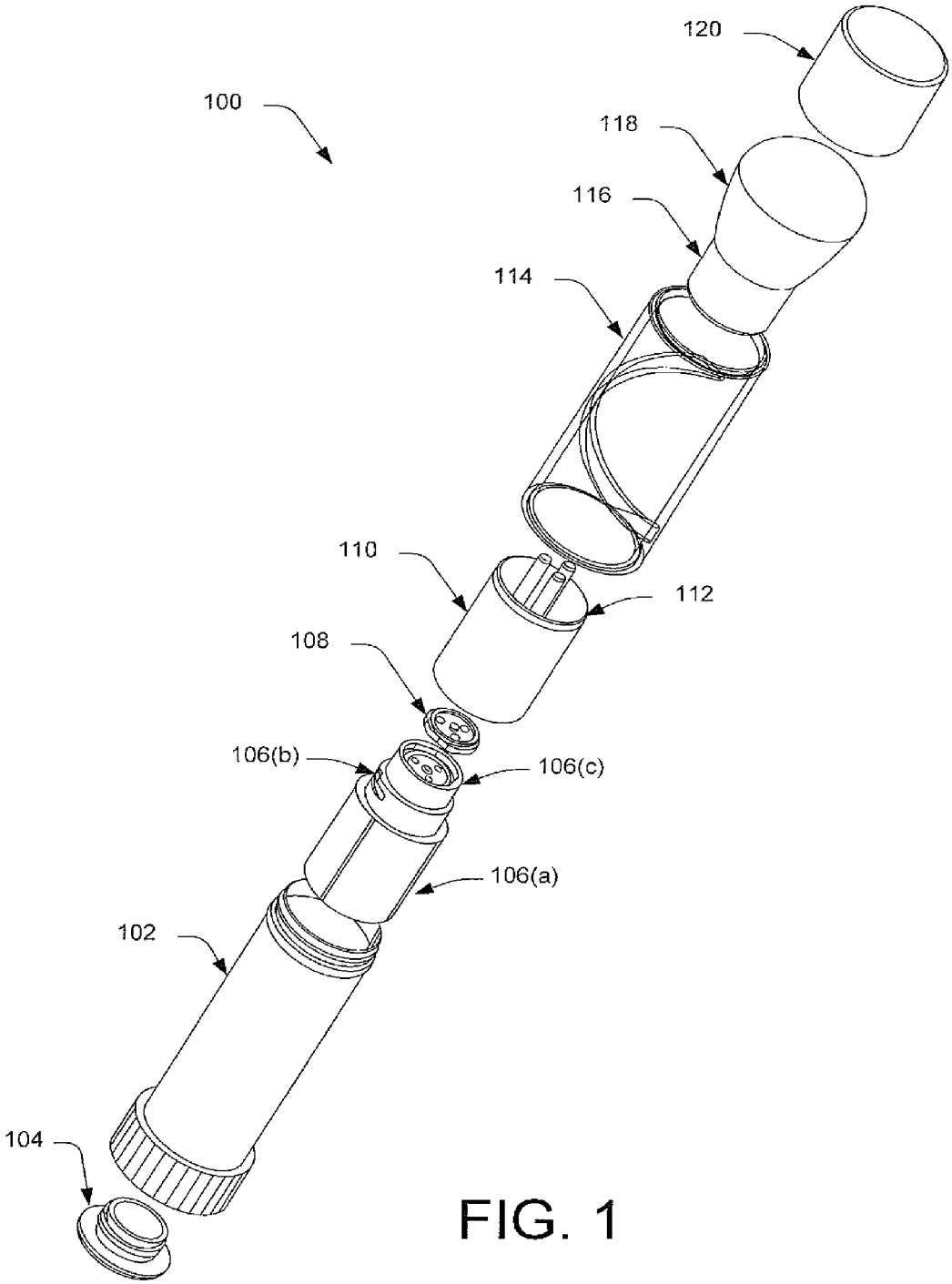
FIG. 1 is an exploded view of an illustrative flow-through dispenser with a helical actuation according to one implementation.

One implementation of this disclosure is directed towards cosmetic dispensers with flow-through gaskets in dispensers using a spiral motion or a helical actuation to dispense cosmetic product and to prevent leakage of the cosmetic product. A cosmetic dispenser includes a lower valve with a reservoir, a flow-through gasket with apertures, and an upper valve. The dispenser being selectively rotatable in a spiral motion between i) an upward position for the dispenser to deliver the cosmetic product and ii) a downward position to store the dispenser. When the dispenser is selectively rotatable in the spiral motion to the upward position to expose an applicator, the lower valve travels along a cam path in an upward slant simultaneously. The cam path in this upward slant position compresses the flow-through gasket at the top to an open state for product delivery. Also, when the dispenser is selectively rotatable in the spiral motion to the downward position, the lower valve travels along the cam path in a downward slant simultaneously. The cam path in this downward slant position compresses the flow-through gasket to a closed state for no product delivery. For implementations, the cam path slant upwards may include an open or a closed position and the cam path slant downwards may include an open or a closed position.

Other implementations include the cam path in a flat not slanted position, which does not compress the flow-through gasket. In this flat position, there are raised sections in the upper valve which aligns with the apertures in the flow-through gasket to a closed position for no product delivery.

In some implementations, there is a product dispenser having a flow-through gasket having at least one aperture and a helical guide slot for rotating the dispenser in a spiral motion or a helical actuation. A user moves a mechanism, such as a collar connected to an upper guide pin on an upper valve and to a lower guide pin on the lower valve, to rotate to an upward position. The guide pin moves along the helical guide slot to the upward position to deliver product. The dispenser is selectively rotatable to a downward position, as the user moves the collar connected to the guide pin. The guide pin moves along the guide slot to the downward position for storage of the dispenser. This implementation includes being selectively rotatable between an open position defining a delivery passageway for a product and a closed position which prevents product leakage.

In yet another implementation, the flow-through dispenser with helical actuation may be refillable. The dispenser includes the lower valve having a reservoir with a refillable cap that may be threaded on and off to refill the reservoir with product. In another implementation, the dispenser includes a separate pot or a bottle that may be replaceable.

By way of example and not limitation, the flow-through dispenser with a helical actuation described herein may be applied in many contexts and environments. For example, the flow-through dispenser with a helical actuation may be implemented for medicinal products, cosmetics and personal care industries, powdered or liquid cosmetic products, mineral products, food products, spices, carpet deodorizers, baking soda, and the like. For example, in various industries, the flow-through dispenser with the helical actuation may be employed for applying powdered, gel, creams, or lotion products. In the cosmetics and personal care industries, Flow-through dispenser with helical actuation may be used to apply lipstick, lip balm, skin creams, lotions, powdered, loose powder, and other cosmetic products to portions of the face and body.

Illustrative Flow-Through Dispenser with Helical Actuation

FIG. 1 is an exploded view of an illustrative flow-through dispenser with helical actuation 100 according to one implementation. In this implementation, the dispenser 100 may be selectively rotatable in a spiral motion between an upward position and a downward position. The upward position may be considered an open state to deliver product. While the downward position may be considered a closed state for no product delivery. When there is no product delivery, the dispenser may be stored for ease of travel.

FIG. 1 represents the illustrative flow-through dispenser with helical actuation 100 having a sleeve 102 with a ridge along the bottom, the sleeve 102 covers or goes over the various components of the flow-through dispenser 100. In some implementations, the sleeve 102 may include an L-shaped design to help guide the dispenser rotation. More details follow on the mechanism of the L-shaped design sleeve 102 discussed in FIG. 2. In some instances, the sleeve 102 may be made of clear, substantially opaque, or translucent materials.

The flow-through dispenser with helical actuation 100 includes an end cap 104 coupled to a lower valve 106(*a*) with a reservoir for containing product. In some implementations, the lower valve 106(*a*) may be constructed as a separate piece from the reservoir. While in other implementations, the lower valve may be constructed with an attached reservoir as one piece. The lower valve 106(*a*) dimensions include but are not limited to, height from at least about 20 mm to at most about 60 mm and diameter from at least 20 mm to at most 35 mm. The end cap or refillable cap 104 keeps the product in the reservoir.

The lower valve 106(*a*) may include a cam path 106(*b*). The cam path 106(*b*) provides a mechanism for the lower valve 106(*a*) to travel to move the dispenser from open to close states and vice versa. As previously mentioned, the dispenser being selectively rotatable in a spiral motion between i) an upward position as an open state and ii) a downward position as a closed state. The lower valve 106(*a*) travels along the cam path 106(*b*) in an upward slant when the dispenser is selectively rotatable in the spiral motion to the upward position. The cam path in this upward slant position compresses the flow-through gasket at the top to the open state for product delivery. The lower valve 106(*a*) travels along the cam path 106(*b*) in a downward slant when the dispenser is selectively rotatable in the spiral motion to the downward position. The cam path in this downward slant position compresses the flow-through gasket to the closed state for no product delivery. There are sections in the lower valve that goes into the flow-through gasket to seal it in the closed state. For various implementations, the cam path slanted upwards or downwards may include either open or closed positions and vice versa.

The lower valve 106(*a*) may include a lower valve seat 106(*c*) or a mouth of the lower valve to hold the flow-through gasket 108. The lower valve seat 106(*c*) includes at least one aperture and at least one or more ridges around the external circumference to form a recessed area.

The ridge surrounding the lower valve seat 106(*c*) provides a mechanism for a flow-through gasket 108 to attach to the lower valve seat 106(*c*). The plurality of apertures in the flow-through gasket 108 is alignable with the plurality of apertures in the lower valve seat 106(*c*) for product delivery. A more detailed discussion of the flow-through gasket 108 follows in FIGS. 5*a*, 5*b*, and 5*c*.

The dispenser 100 also includes an upper valve 110. The upper valve 110 may include an attachment seat 112 that is co-molded together as one piece or may be formed of two separate pieces. The attachment seat 112 may include a plurality of pipes as shown in the figure or alternatively, there may not be any pipes in the attachment seat 112 but would include at least one aperture alternating with at least one or more raised sections. As mentioned previously, when the cam path 106(*b*) is in a flat or not slanted position, the flow-through gasket is not compressed. In this flat position, the raised sections in the attachment seat 112/upper valve 110 aligns with the apertures in the flow-through gasket 108 to a closed position for no product delivery.

As mentioned above, the lower valve 106(*a*), the flow-through gasket 108, and the upper valve 110 are capable of being selectively rotatable in a spiral motion in an upward position for product delivery. This open state allows at least one pipe or one aperture in the upper valve 110 being alignable with the at least one aperture in the flow-through gasket 108 and being alignable with the at least one aperture in the lower valve seat 106(*c*) to operate in the open position to deliver product. This downward position allows the at least one raised section in the upper valve 110 being alignable with the at least one aperture in the flow-through gasket 108 to operate in a closed position. This closed position prevents leakage of the product.

This spiral rotation mechanism may range from at least about ten degrees to at most about 359 degrees. In some implementations, the spiral rotation mechanism may range from at least about 15 degrees to at most about 300 degrees. Furthermore, the flow-through gasket 108 allows a controlled rate of product to be dispensed at one time without product being distributed all over the user or creating a mess in a purse or a carrying type device.

The at least one aperture in the lower valve seat 106(*c*), the flow-through gasket 108, and the upper valve 110 may have shapes that include but are not limited to, substantially circular-shaped, substantially square-shaped, or substantially oval-shaped. The number of apertures in the lower valve seat 106(*c*), the flow-through gasket 108, and the upper valve 110 may range from at least about one to at most about five apertures. The size of the apertures in the lower valve seat 106(*c*), the flow-through gasket 108, and the upper valve 110 is of a sufficient size and of an adequate opening to allow for product delivery without being plugged. For example, the size of the apertures may range from at least about 1 mm to at most about 6 mm. In one implementation, each aperture is at least about 2.5 mm in size. The configuration of the apertures may range from three apertures positioned at 120 degrees apart from each other. In another implementation, the configuration of the apertures may range from four apertures positioned at 90 degrees apart from each other. The shape, number, and size of the apertures in the lower valve seat 106(*c*), the flow-through gasket 108, and the upper valve 110 may be different in relation to each other.

The at least one pipe in the attachment seat 112 may range in length from at least about 9 mm to at most about 35 mm and may range in diameter from at least about 2 mm to at most about 4 mm. The number and the diameter size of the pipes and the number and diameter size of the raised sections on the upper valve 110 may be similar or not similar in the number and diameter size of apertures in the flow-through gasket 108 and the lower valve seat 106(*c*). In an implementation, a similar size diameter for the apertures on the flow-through gasket 108 and pipes on the attachment seat 112 allows for product delivery while having a similar size diameter of the raised sections on the upper valve 110 and with the plurality of apertures in the flow-through gasket 108 prevents product leakage. In other implementations, there may be alternate different mechanisms to deliver product and to prevent product leakage.

The lower valve 106(*a*) may be secured to the end cap 104 and to the upper valve 110, by, for example, a press-fit, a snap-fit, adhesive, and/or engagement by one or more engagement features. In the illustrated implementation, the lower valve 106(*a*) may include ribs to couple to the upper valve 110.

Shown in FIG. 1 is a collar 114 that goes over the sleeve 102 of the dispenser 100. Details of the sleeve and collar are discussed in FIG. 2.

The sleeve 102, the end cap 104, the lower valve 106(*a*), the upper valve 110, the pipes 112, and the collar 114 may be constructed of materials including, but not limited to, wood, plastics, polymers, thermoplastics, composites thereof, or the like. In some implementations, the sleeve 102, the end cap 104, the lower valve 106(*a*), the upper valve 110, the pipes 112, and the collar 114 may be made at least partially of a resin such as, for example, acrylonitrile butadiene styrene (ABS), styrene acrylonitrile (SAN), pentachlorothioanisole (PCTA), polypropylene (PP), polyethylene (PE), Polyurethane, combinations thereof, or the like.

The flow-through dispenser with helical actuation may include a lock type mechanism to avoid accidentally moving the dispenser into a spiral motion. For example, the dispenser will not selectively rotate from the upward open position to the downward closed position and vice versa, unless a user manually rotates the dispenser. For ease of convenience, the term "flow-through dispenser with helical actuation" may be used interchangeably with the versions of "flow-through dispenser" or "spiral rotation".

Illustrative Applicator and Cap for Flow-Through Dispenser with Helical Actuation FIG. 1 shows the flow-through dispenser with helical actuation 100, which includes an attachment fixture 116 that is coupled to the attachment seat 112 and the upper valve 110. The attachment fixture 116 includes at least one aperture selectively alignable with the at least one pipe from the attachment seat 112 for product delivery. The attachment fixture 116 may include at least one aperture that would function as sleeves to go over the pipes on the attachment seat 112 of the upper valve 110.

In implementations with no pipes, the attachment fixture 116 may include at least one aperture that aligns with the at least one aperture in the attachment seat 112. The aperture may range in number from at least about one to at most about six apertures. The aperture may range in size from at least about 2 mm to at most about 4 mm in diameter. The number and diameter size of the apertures in the attachment fixture 116 may match the number and diameter size of the apertures or pipes in the attachment seat 112.

The attachment fixture 116 is coupled to a bottom of an applicator 118. The applicator 118 may include but is not limited to, a brush, a sponge, or a powder puff to apply the product. In some implementations, the applicator may be used to apply products including but not limited to, cosmetic powdered products, gel or lotion products, and the like.

As mentioned, the dispenser 100 is capable of being selectively rotatable in the spiral motion to the upward position. This upward position allows the applicator 118 to be selectively rotatable raised or exposed to deliver product. Also, the dispenser 100 is capable of being selectively rotatable in the spiral motion to a downward position. This downward position allows the applicator 118 to be selectively retractable for storing the dispenser, not providing a delivery mechanism.

The flow-through dispenser with helical actuation 100 may include a removable cap 120 or a cover that is sized and shaped to fit over the top of the brush applicator 118. In an implementation, the removable cap 120 may snap onto the collar 114. In another implementation, the removable cap 120 may include threads to screw onto the collar 114 that mates with it. In other implementations, the flow-through dispenser with helical actuation 100 may include a clear plastic cover, a sliding pull up cover, and the like. In this illustration, the dispenser 100 includes the removable cap 120 that encapsulates the brush applicator 118 when the dispenser 100 is not in use. In another implementation, the dispenser 100 may not include a removable cap or cover.

The removable cap 120 may include a mirror (not shown) for convenience of the user to have the mirror readily available when applying the product. The mirror may range in thickness from at least about two mm to at most about eight mm. The mirror may be located on the top, the side, or inside the removable cap 120. In another implementation, the dispenser 100 may not include a mirror.

While features of various illustrative implementations are described, in other implementations, the sleeve 102, the end cap 104, the lower valve 106(*a*), the upper valve 110, the collar 114, the attachment fixture 116, the brush applicator 118, the cap 120, and the mirror may be configured in any form suitable for the application of the product contained in dispenser 100. For example, the above items listed may be constructed in any other suitable shape and size and may have any suitable mass, surface finish, and/or surface treatment desired for a given application. In practice, the above items listed may be configured in virtually any desired shape, such as disk-shaped, oval, elliptical, spherical, curvilinear, trapezoidal, or the like.

Illustrative Helical Actuation for Flow-Through Dispenser

Figure 2:
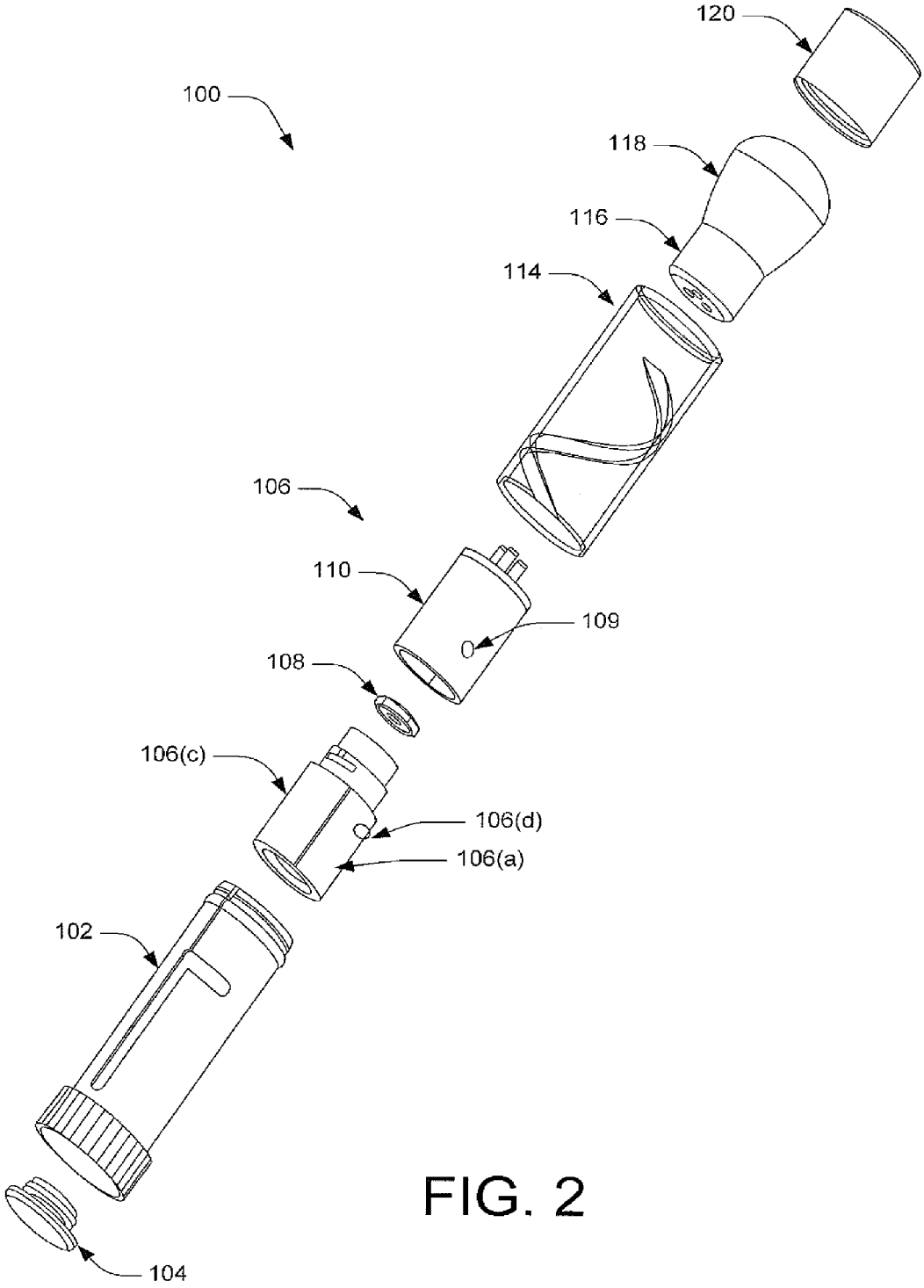
FIG. 2 is another exploded view of the illustrative flow-through dispenser with a helical actuation according to the implementation of FIG. 1.

FIG. 2 is another exploded view of the illustrative flow-through dispenser with a helical actuation according to the implementation of FIG. 1.

The following is a discussion of examples, without limitation, of delivery mechanisms for dispensing a product in a selectively rotatable position in the spiral motion between the upward position and the downward position. The upward position is an open state to deliver product and the downward position is a closed state to store the dispenser. The examples may be implemented using a rotation or a reverse rotation operation, a clockwise or a counterclockwise direction, a left rotation or a right rotation, vice versa, whereby a user may operate the flow-through dispenser 100. The positions may be referred to as raised and retracted positions. However, in other implementations, any suitable delivery mechanism may be used.

The dispenser 100 illustrates an L-shaped guide slot on the sleeve 102, a lower guide pin 106(*d*) on the lower valve 106(*a*), an upper guide pin 109 on the upper valve 110, and the helical guide path or slot on the collar 114.

In this implementation, the flow-through gasket 108 is assembled with the lower valve 106(*a*). The flow-through gasket 108 is disposed on the mouth of the lower valve seat 106(*c*). The at least one aperture in the flow-through gasket and the at least one aperture in the lower valve seat 106(*c*) are selectively aligned. The upper valve 110 is connected to the lower valve 106(*a*) by aligning the upper guide pin 109 on the upper valve 110 to the lower guide pin 106(*d*) on the lower valve 106(*a*). At this position of alignment of the two guide pins, the at least one aperture in the upper valve 110 is not aligned with the at least one aperture of the flow-through gasket 108 and the lower valve 106(*a*). Therefore, there is no passageway for product delivery and this position may be referred to as a closed state.

The user may selectively rotate the collar 114 to an upward or a downward position. The guide pin on the upper valve 110 extends into the helical guide slot of the collar 114 and is guided along this path as the user manipulates the collar 114 between the upward and downward positions. The components, the lower valve 106(*a*), the flow-through gasket, and the upper valve 110 travel in an upward helical motion along this path.

During rotation by the user, the guide pin on the upper valve 110 may travel along the helical guide path to the top and is simultaneously guided into the upper top portion of the L-shaped configuration on the sleeve 102 to the upward position. When the upper guide pin 109 travels along the L-shaped configuration on the sleeve 102, the upper valve 110 is selectively rotatable toward this path. The motion into the L-shaped configuration misaligns or rotates the upper guide pin 109 away from the lower guide pin 106(*d*). However, this motion then selectively aligns the at least one aperture in the upper valve 110 to align with the at least one aperture in the flow-through gasket 108 and with the at least one aperture in the lower valve seat 106(*c*) (these two are already aligned). This alignment creates an open state for product delivery. In this upward raised position and opened state, the applicator is exposed or raised for use.

The L-shape configuration may range from a length of about at least about 25 mm to at most about 60 mm and range in diameter from at least about three mm to at most about ten mm. Other guide shapes, sizes, and configurations may be used. These include but are not limited to t-shaped, reverse L-shaped, substantially 90 to 120 degrees, and the like.

Figure 3A:
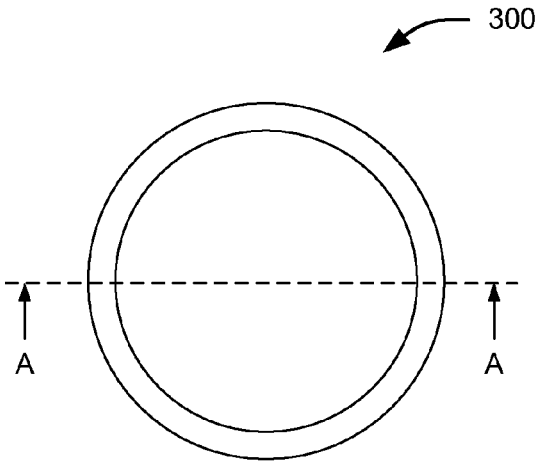
FIG. 3*a* is a top plan view, taken along line A-A of a dispenser cap for a flow-through dispenser with a helical actuation according to another illustrative implementation.
Figure 3B:
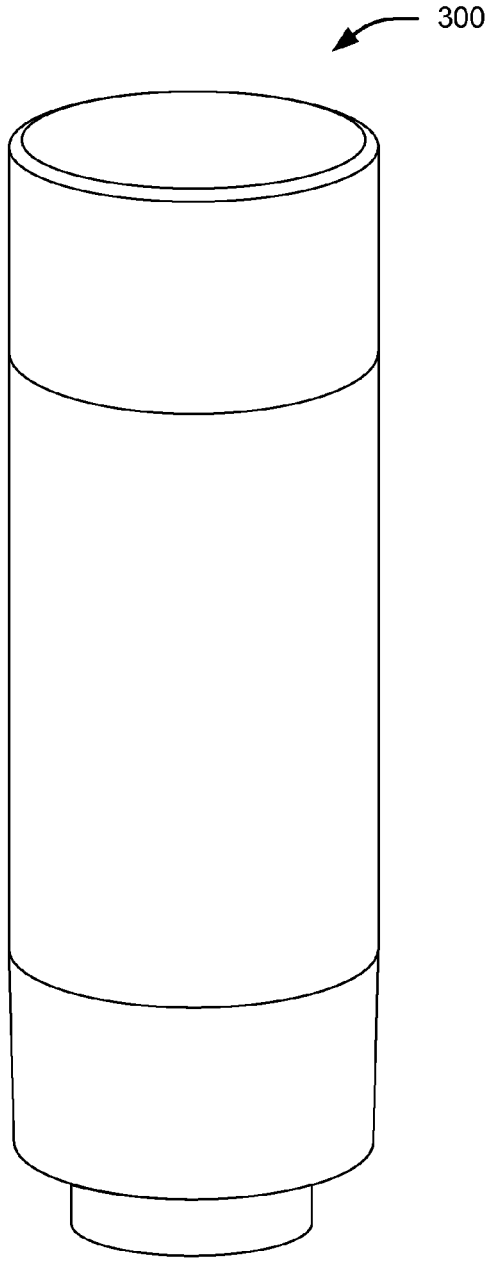
FIG. 3*b* is a perspective exterior view of the flow-through dispenser with a helical actuation according to the implementation of FIG. 3*a;*

FIG. 3*a* is a top plan view, taken along line A-A of a dispenser cap for a flow-through dispenser with a helical actuation according to another illustrative implementation. FIG. 3*b* is an exterior view of the flow-through dispenser with helical actuation with a cap according to an implementation.

Figure 4:
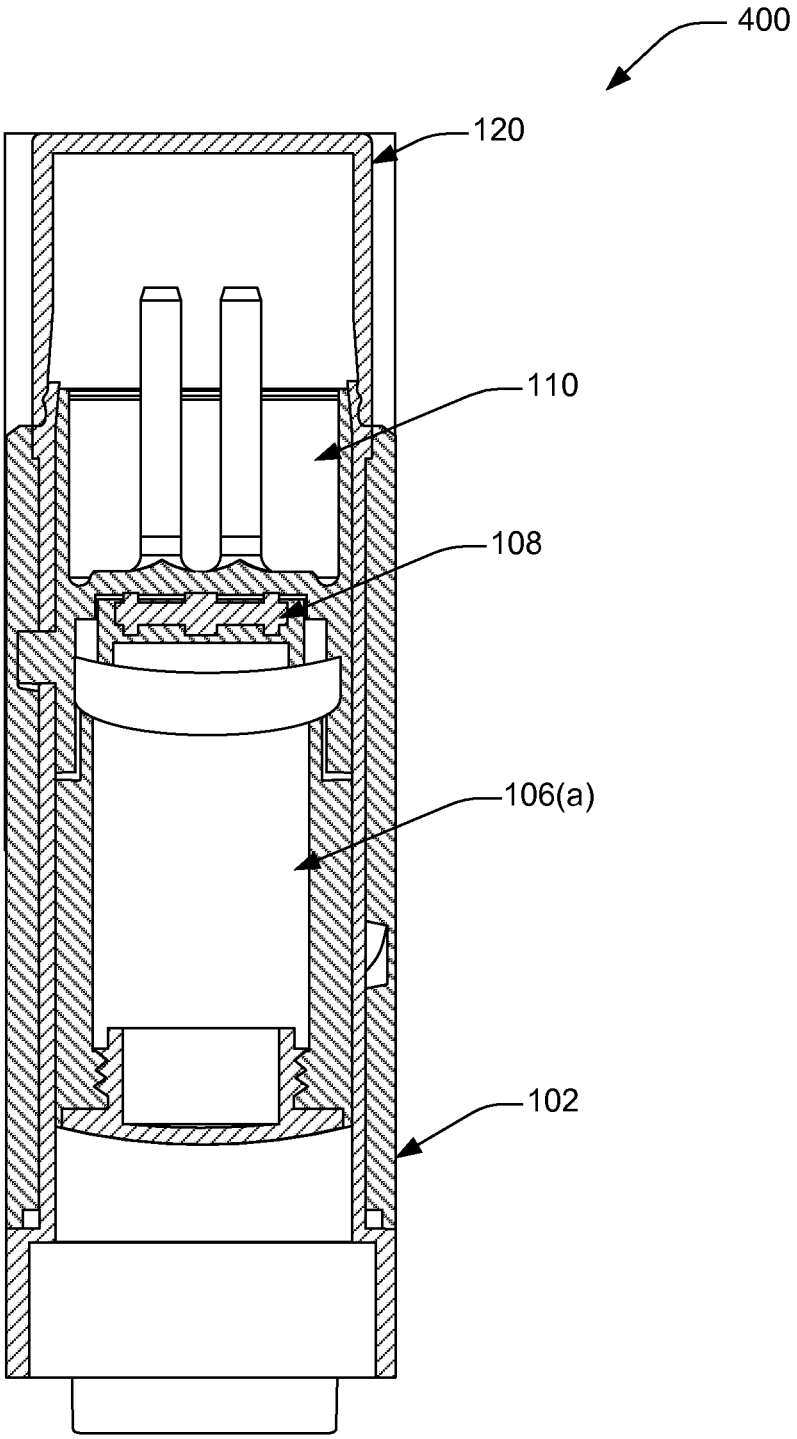
FIG. 4 is a cross-sectional view of an illustrative flow-through dispenser with a helical actuation according to one implementation.

Illustrative Delivery Mechanism for Flow-Through Dispenser with Helical Actuation FIG. 4 is a cross-sectional view of the flow-through dispenser 400 according to an implementation. As shown in the cross sectional view for FIG. 4, the flow-through dispenser 400 illustrates the sleeve 102, the lower valve 106(*a*), the flow-through gasket 108, a plurality of pipes, the upper valve 110 and a cap 120. In implementations, the flow-through gasket 108 moves vertically as selectively rotated in a spiral motion between the upward and downward positions. However, in other implementations, any movement of the gasket may be used.

Shown in FIG. 4 is how a product delivery passageway extends from the reservoir in the lower valve 106(*a*) and terminates in the plurality of pipes. In one example, the upper valve 110 serves as an operating mechanism to allow product delivery in the open position. The upper valve 110 being selectively rotatable in a spiral motion to the upward position which is the open state. As mentioned previously, this open state causes a plurality of pipes or apertures in the upper valve 110 to be selectively alignable with a plurality of apertures of the flow-through gasket 108 with the plurality of apertures in the lower valve 106(*a*), such that the product is transported through this product delivery passageway. Thus, the product is dispensed from the reservoir in the lower valve 106(*a*) through the plurality of apertures in the lower valve 106(*a*) through the plurality of apertures in the flow-through gasket 108 through a plurality of pipes or a plurality of apertures in the upper valve 110.

In one example, the lower valve 106(*a*) and the upper valve 110 rotate in the spiral motion downward and the applicator brush 118 selectively rotates into a retracted position. This downward position stores the dispenser. Also, in this downward position, there is no product leakage as there is not a delivery passageway. A downward motion may cause the plurality of raised sections in the upper valve 110 to be selectively alignable with the plurality of apertures in the flow-through gasket 108 to prevent product leakage. In this closed position, there is no product leakage by not defining a product delivery passageway.

In implementations, the rotation mechanism may include a rotation of at least about 15 degrees to at most about 300 degrees to the open position. In other implementations, the rotation mechanism may include a rotation at a minimum of at least about 5 degrees to at most about 355 degrees. Another example for delivery mechanism for dispensing the product may be a rotation of at least about 180 degrees, relative to a sufficient number of the plurality of apertures and a sufficient size of the plurality of apertures in the flow-through gasket.

Actuation may also occur by turning, depressing, sliding, tilting, or otherwise manipulating an outer cover, a knob on an outer cover, a button, and/or by any other suitable dispensing mechanism. In an implementation, the user manipulates a knob on the outer cover for product delivery. However, in other implementations, any suitable delivery mechanism may be used.

Figure 5A:
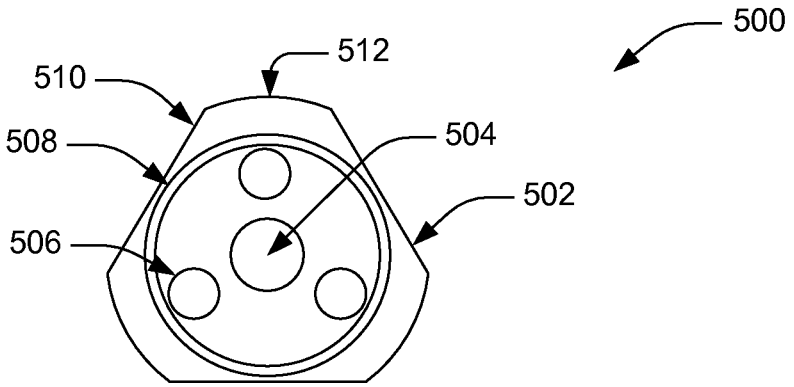
FIGS. 5*a*, 5*b*, and 5*c* are a bottom view, a top plan view, and a perspective plan view respectively, of an illustrative flow-through gasket according to one implementation.
Figure 5B:
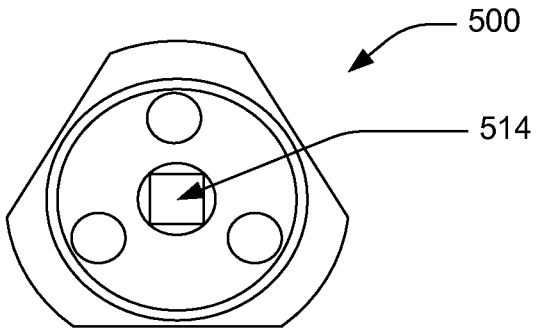
Figure 5C:
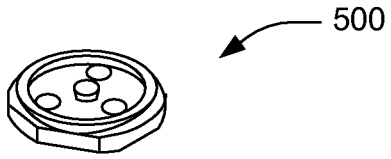

Illustrative Flow-Through Gasket for Flow-Through Dispenser with Helical Actuation FIGS. 5*a*, 5*b*, and 5*c* are a bottom view, a top plan view, and a perspective view respectively, of an illustrative flow-through gasket according to one implementation. FIG. 5*a* illustrates the flow-through gasket 500 having a substantially disk-shaped body 502 with a top raised center section on a top side 504. The top raised center section 504 may be substantially circular-shaped, substantially square-shaped, or substantially oval-shaped. In this diagram, the top raised center section 504 is substantially circular-shaped.

FIG. 5*a* shows the plurality of apertures 506 located on the substantially disk-shaped body 502. The plurality of apertures 506 is selectively alignable with the plurality of apertures of the lower valve 106(*a*) and with the plurality of pipes or with the plurality of apertures in the upper valve 110 to deliver the product. The apertures 506 in the flow-through gasket 500 may have shapes that includes but are not limited to, substantially circular-shaped, substantially square-shaped, or substantially oval-shaped. Shown are apertures 506 that are substantially circular-shaped.

The size of the plurality of apertures 506 are of a sufficient size to allow for product delivery without being plugged. The size of the aperture is of an adequate opening to allow the powdered particles to travel through the plurality of apertures 506. For example, the size of the apertures 506 in the flow-through gasket 500 may range from at least about 1 mm to at most about 6 mm. In one implementation, the aperture 506 is at least about 2 mm diameter in size.

The number of the plurality of apertures 506 is of a sufficient number to allow for product delivery in the open position, but is somewhat dependent on the size of the apertures. In an implementation, there may be three apertures as shown. In other implementations, the apertures may include but is not limited to, from at least about one aperture to at most about four apertures.

The arrangement of the apertures 506 may be in a triangular configuration as shown. In another implementation, the arrangement may be in various configurations, including but not limited to a square or a circular configuration. In one implementation, there may be three apertures spaced at 120 degrees apart from each other while in another implementation, there may be four apertures spaced at 90 degrees apart from each other.

The substantially disk-shaped body 502 includes a circular ring 508 on each side of the disk-shaped body 502. In one implementation, a first circular ring surrounds the apertures and is to couple to the mouth of the lower valve 106(*a*) on one side and a second circular ring surrounds the apertures and is to couple to the upper valve 110 on the outer side.

The flow-through gasket 500 includes an outer perimeter having a plurality of flat sides 510 and a plurality of semicircular sides 512, alternating, on the substantially disk-shape body. The plurality of semicircular sides 512 holds the flow-through gasket 500 secure against the upper valve 110 or the lower valve 106(*a*) upon actuation in the various implementations. The plurality of flat sides 510 may apply to any sides of the substantially disk-shaped body 502. For example, the flat sides 510 may include, but is not limited to three sides arranged in a triangle type formation or configuration. The semicircular side 512 may apply to any sides of the substantially disk-shaped body 502.

The semicircular sides 512 arranged in a triangle type formation or configuration. In an implementation, the substantially disk-shaped body 502 may include alternating flat sides 510 with alternating semicircular sides 512. The number of semicircular sides and flat sides may each range from at least about one to the most about four.

FIG. 5*b* shows the other side of the substantially disk-shaped body 502 of the flow-through gasket. The center-raised section 514 in the flow-through gasket 500 may be substantially squared-shaped. The center-raised section 514 may have shapes that includes but are not limited to, substantially circular-shaped, substantially square-shaped, or substantially oval-shaped.

FIG. 5*c* shows a perspective view of the flow-through gasket 500. The flow-through gasket 500 is made of a material capable of having elastomeric properties. The materials include but are not limited to, a thermoplastic elastomer (TPE), a thermoplastic polymer, a polyvinyl chloride, a polyurethane, polyester copolymer, styrene copolymer, olefin, ethylene acrylic, chlorinated polyethylene, chlorosulfonated polyethylene, fluorocarbon, rubber, while in other implementations, the elastomeric material may comprise a relatively pliable or gel-like material such as butyl rubber, silicone, butadiene rubber, neoprene, nitrile, fluorosilicone, styrene-butadiene rubber (SBR), or the like.

In an implementation, the flow-through gasket is formed integrally with the lower valve 106(*a*). The two components would be formed as one piece, but the flow-through gasket 500 would be formed of one of the materials as identified above while the lower valve 106(*a*) would be formed from the list of materials as previously discussed.

While features of various illustrative implementations are described, in other implementations, the flow-through gasket 500 may be configured in any form suitable for the application of the product contained in the dispenser. For example, the flow-through gasket 500 may be constructed in any other suitable shape and size and may have any suitable number of apertures, size of apertures, shape of apertures desired for a given application. The size, number, and shape of the apertures on the flow-through gasket 500 may vary between implementations. Fabrication of the dispenser and the flow-through gasket 500 may be accomplished through a separate manufacturing process, a co-molding process, or any other suitable production process.

Illustrative Flow-Through Dispensers with Helical Actuation

FIGS. 6-9 illustrate other implementations of the flow-through dispenser with helical actuation.

Figure 6:
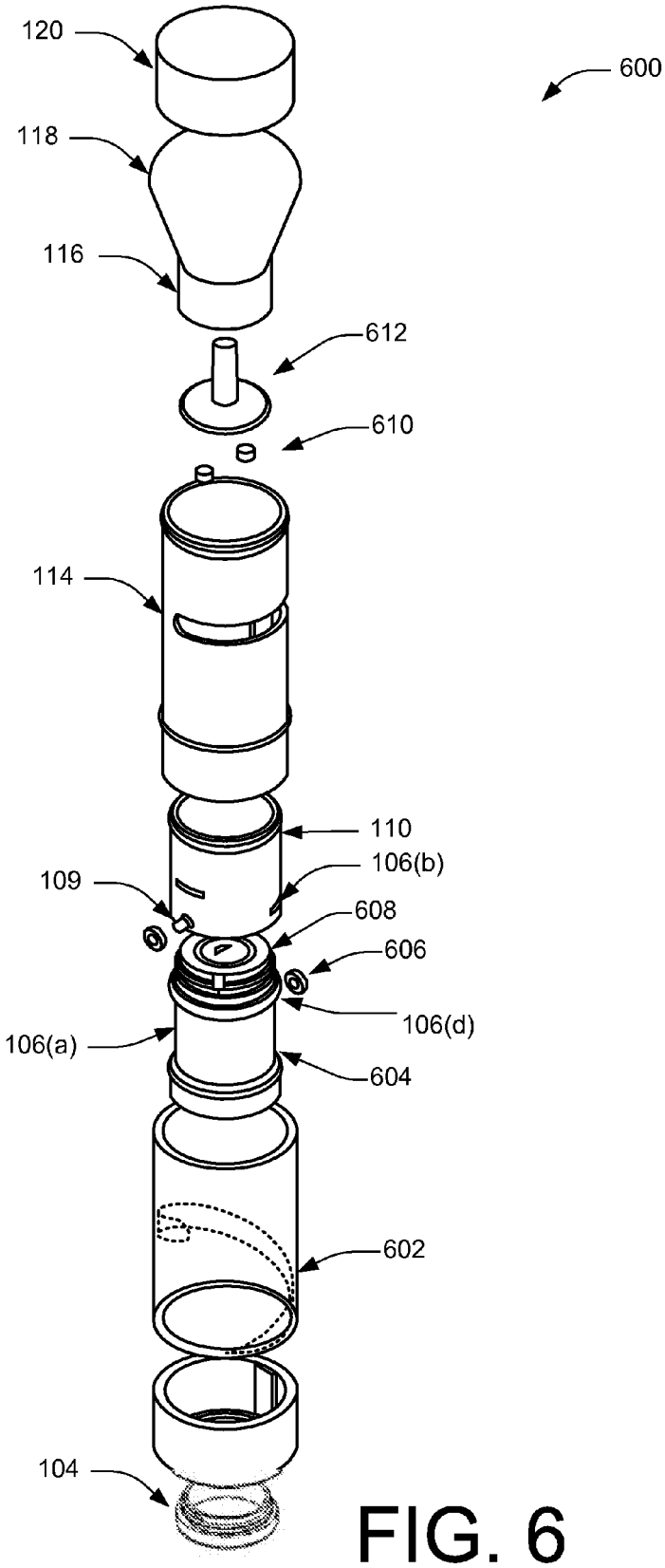
FIG. 6 is an exploded view of an illustrative dispenser with a flow-through dispenser with a helical actuation according to another illustrative implementation.

FIG. 6 is an exploded view of an illustrative flow-through dispenser with helical actuation according to one implementation. It is understood these illustrative flow-through dispensers have features similar to the components and features of the flow-through dispensers as discussed for FIGS. 1 and 2. However, the following descriptions will focus on features that are different for other implementations of the flow-through dispensers.

In this implementation for FIG. 6, the dispenser 600 includes a reservoir that is attached to the lower valve 604, optional Teflon® coated washers 606, flow-through gasket 608, magnets 610 for removable applicators, and at least one pipe 612.

The reservoir 604 is attached and may be formed integrally with the lower valve or may be formed as two separate pieces. The reservoir 604 is closed with the end cap to store the product. The Teflon® coated washers 606 are located on a knob or guide pin of the upper valve and on the knob of the lower valve to allow for a smoother rotation when travelling within the helix 602 and within the L-shaped guide slot located on the collar. The flow-through gasket 608 is discussed and shown in FIG. 7. The magnets 610 are attached to different applicators that may be used depending on the product and application need, such as a brush, a powder puff, a sponge. This implementation illustrates at least one pipe 612 that may be used in the dispenser.

Figure 7:
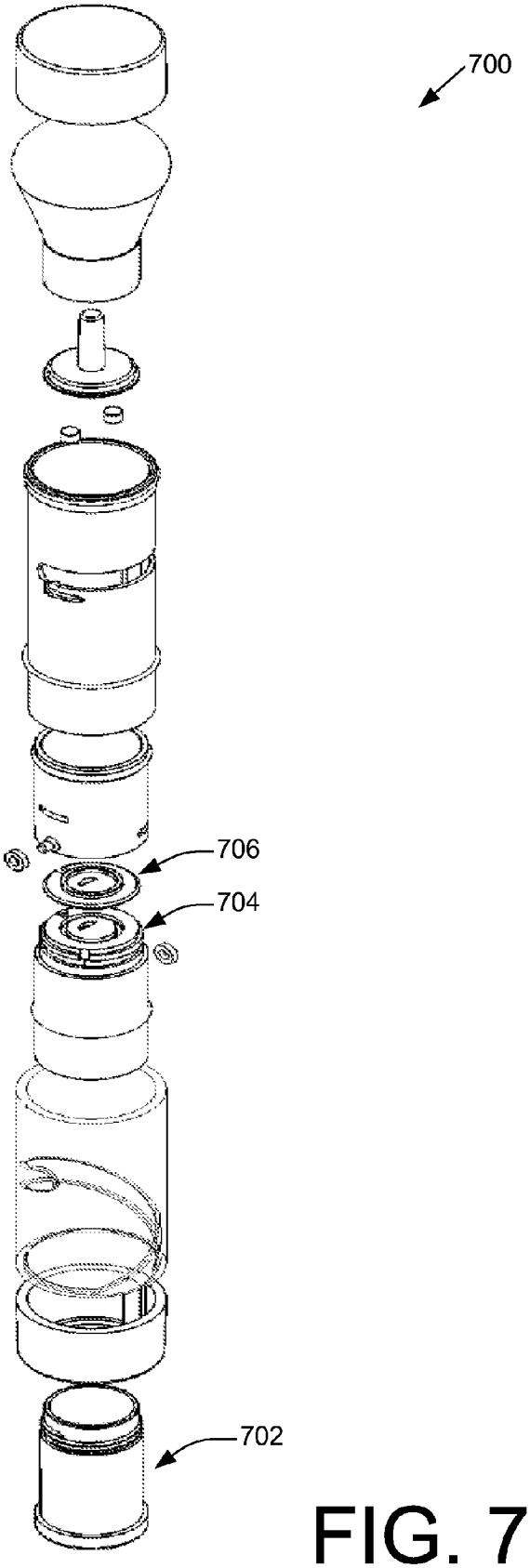
FIG. 7 is an exploded view of an illustrative dispenser with a flow-through dispenser with a helical actuation according to yet another illustrative implementation.

FIG. 7 illustrates the dispenser 700 having a reservoir, a pot, a bottle, or a container 702 that may be refillable or replaceable, a disk-shaped lower valve seat 704, and a disk-shaped gasket 706. The refillable pot, bottle, or container 702 may include a refillable cap and a top with at least one aperture. The refillable bottle 702 would be refilled with product via the neck of the bottle. Alternatively, the pot, bottle, or container 702 may be replaceable with a new one once the container is empty. Here, the flow-through gasket 706 includes at least one aperture that may be configured in an S shaped, a wavy S-shaped, a half circular shaped, and the like. The flow-through gasket 706 is disposed on the mouth of the lower valve seat 704.

Figure 8:
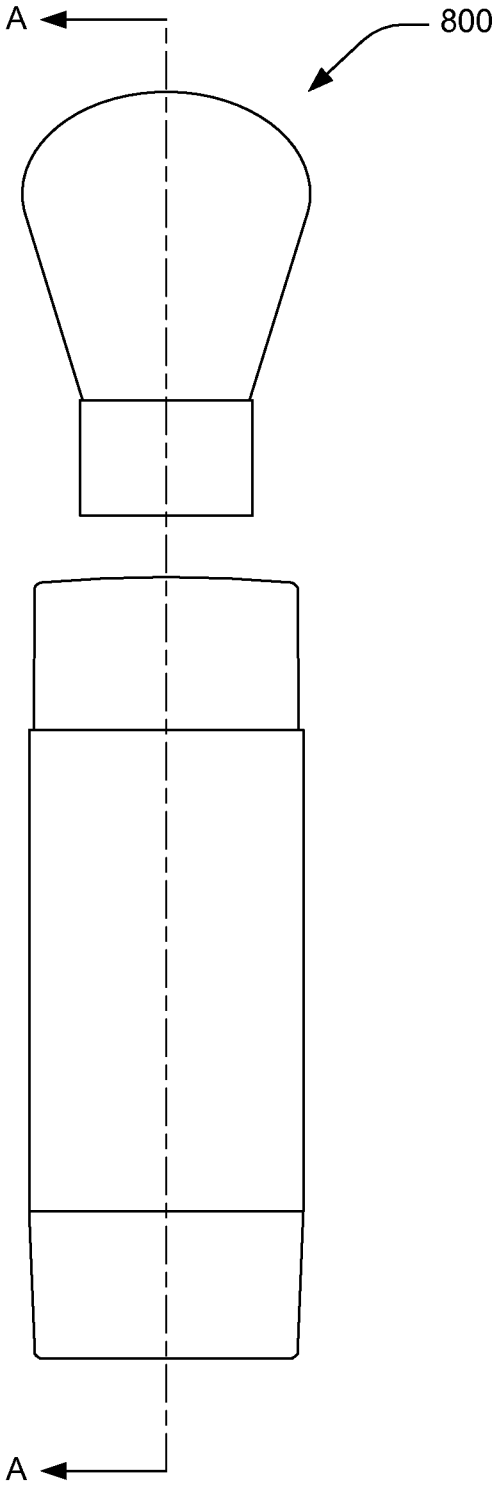
FIG. 8 is a perspective exterior view, taken along line A-A of a flow-through dispenser with a helical actuation according to an illustrative implementation.
Figure 9:
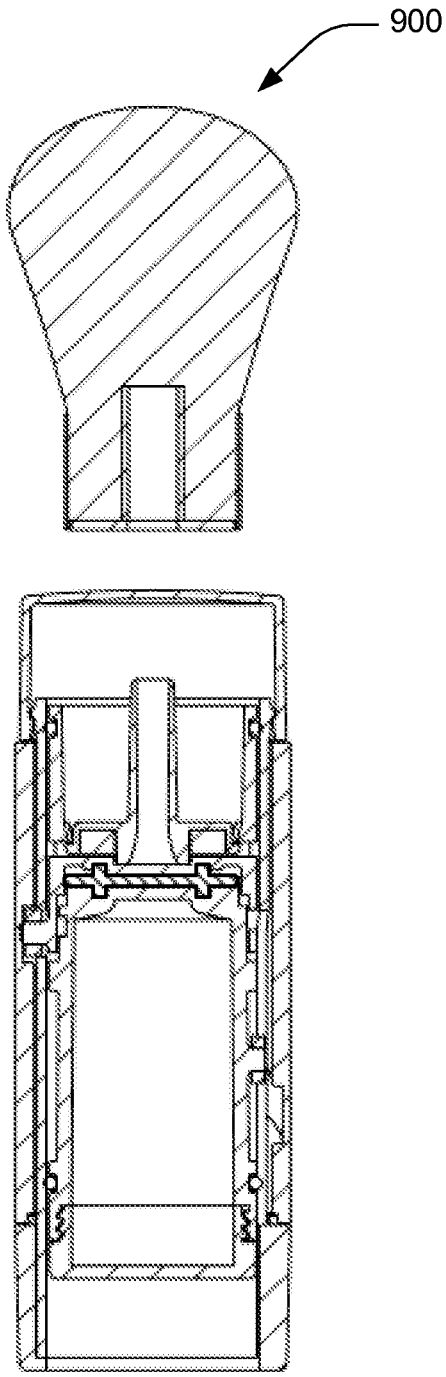
FIG. 9 is a cross-sectional view of a flow-through dispenser with a helical actuation according to another illustrative implementation.

FIG. 8 is a cross-sectional view of a flow-through dispenser according to one implementation. FIG. 9 is a perspective exterior view, taken along line A-A of an illustrative flow-through dispenser according to one implementation.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention.

What is claimed is:

1. A cosmetic dispenser comprising:

a lower valve having a reservoir for containing a product, the lower valve having at least one aperture;

an upper valve coupled to the lower valve, the upper valve having at least one aperture; and a flow-through gasket interposed between the lower valve and the upper valve, the flow through gasket comprising at least one aperture;

the upper valve being rotatable, relative to the flow-through gasket and the lower valve, in a spiral motion between:

i) an upward position to decompress the flow-through gasket for the dispenser to deliver the product; and ii) a downward position to compress the flow-through gasket for storage of the dispenser; and an applicator coupled to the upper valve for applying the product.

2. The cosmetic dispenser of claim 1, wherein the flow-through gasket comprises:

a substantially disk-shaped body with a top raised center section on a top side and a bottom raised center section on a bottom side;

the at least one aperture being located on the substantially disk-shaped body and being alignable with the at least one aperture of the lower valve and with the at least one aperture of the upper valve to define a delivery passageway for the product;

a first circular ring surrounding the at least one aperture on the bottom side of the substantially disk-shaped body, the first circular ring to couple the flow-through gasket to the lower valve;

a second circular ring surrounding the at least one aperture on the top side of the substantially disk-shaped body, the second circular ring to couple the flow-through gasket to the upper valve; and an outer perimeter comprising a plurality of flat sides and a plurality of semicircular sides alternating on the substantially disk-shaped body, the plurality of semicircular sides to hold the flow-through gasket in place when actuation occurs.

3. The cosmetic dispenser of claim 1, wherein the flow-through gasket comprises a thermoplastic elastomer (TPE) material.

4. The cosmetic dispenser of claim 1, wherein the at least one aperture in the flow-through gasket comprises a substantially circular-shape, a substantially square-shape, or a substantially oval-shape.

5. The cosmetic dispenser of claim 1, wherein the upper valve comprises at least one pipe for product delivery.

6. The cosmetic dispenser of claim 1, wherein the reservoir comprises a refillable bottle, such that the refillable bottle is removable to refill the bottle with product.

7. The cosmetic dispenser of claim 1, wherein the spiral rotation between the upward and downward positions comprises an actuation of at least about 15 degrees to at most about 300 degrees.

8. The cosmetic dispenser of claim 1, wherein the flow-through gasket moves vertically between the upper valve and the lower valve during rotation in the spiral motion between upward and downward positions.

9. The cosmetic dispenser of claim 1, wherein the flow-through gasket rotates as the lower valve is rotated during rotation in the spiral motion between upward and downward positions.

10. The cosmetic dispenser of claim 1, wherein rotation in the spiral motion to an upward position comprises the applicator being raised relative to the upper valve to deliver the product.

11. The cosmetic dispenser of claim 1, wherein rotation in the spiral motion to a downward position comprises the applicator being retractable for ease of storage.

12. The cosmetic dispenser of claim 1, further comprising:

a helical guide slot located on a collar of the dispenser; and an upper guide pin located on the upper valve and a lower guide pin on the lower valve, the upper and lower guide pins being movable along the helical guide slot.

13. The cosmetic dispenser of claim 12, wherein the cosmetic dispenser is configured such that a rotation of the collar causes the upper and lower guide pins to move along the helical guide slot causing the upper valve, the flow-through gasket, and the lower valve to move between:

i) an upward position along the helical guide slot for the dispenser to deliver the product, and ii) a downward position along the helical guide slot to store the dispenser.

14. A dispenser comprising:

a lower valve having a reservoir for containing a product;

an upper valve coupled to the lower valve, the upper valve and the lower valve being moveable between a raised position and a retracted position relative to each other;

an applicator coupled to the upper valve for applying the product; and a flow-through gasket interposed between the lower valve and the upper valve, the flow-through gasket comprising at least one aperture and comprising an elastomer material, wherein moving the upper valve and the lower valve to the retracted position compresses the flow-through gasket between the upper valve and the lower valve.

15. The dispenser of claim 14, wherein the raised position defines a use position to deliver product and the retracted position defines a non-use position to store the dispenser.

16. The dispenser of claim 14, wherein in the raised position, the at least one aperture in the upper valve aligns with at least one aperture in the flow-through gasket and with at least one aperture in the lower valve to create a delivery passageway, and wherein in the retracted position, the at least one aperture in the upper valve does not align with at least one aperture in the flow-through gasket and with at least one aperture in the lower valve, such that the delivery passageway is closed to prevent product leakage.

17. The dispenser of claim 14, further comprising a spiral motion between the raised and retracted positions.

18. The dispenser of claim 14, further comprising:

a helical guide slot located on a collar of the dispenser;

an L-shaped configuration located on a sleeve covered by the collar; and an upper guide pin located on the upper valve and a lower guide pin on the lower valve, the upper and lower guide pins being movable along the helical guide slot in a spiral motion; and wherein the upper guide pin being movable along the helical guide slot and the L-shaped configuration.

19. The cosmetic dispenser of claim 18, wherein the cosmetic dispenser is configured such that rotation of the collar causes the upper and the lower guide pins to move along the helical guide slot causing the upper valve, the flow-through gasket, and the lower valve to move between: an upward position along the helical guide slot for the dispenser to deliver the product, and a downward position along the helical guide slot to store the dispenser.

20. The dispenser of claim 14, wherein in the raised position, the applicator, the upper valve, the flow-through gasket, and the lower valve are raised to deliver product, and in the retracted position, the applicator, the upper valve, the flow-through gasket, and the lower valve are retracted to store the dispenser.

21. The dispenser of claim 14, wherein the dispenser is configured such that the flow-through gasket moves vertically during rotation between the raised position and the retracted position.

22. The dispenser of claim 14, wherein the flow-through gasket comprises:

a substantially disk-shaped body with a top raised center section and a bottom raised center section;

a first circular ring surrounding the at least one aperture on a bottom side of the substantially disk-shaped body; and a second circular ring surrounding the at least one aperture on a top side of the substantially disk-shaped body.

23. The dispenser of claim 14, wherein an outer perimeter of the flow-through gasket comprises a plurality of flat sides and a plurality of semicircular sides, alternating on the substantially disk-shaped body.

24. A dispenser with a helical guide slot comprising:

a lower valve having a reservoir for containing a product, the lower valve having at least one aperture;

an upper valve coupled to the lower valve, the upper valve having at least one aperture;

a flow-through gasket interposed between the lower valve and the upper valve, the flow through gasket comprising at least one aperture;

the upper valve being rotatable relative to the flow-through gasket and the lower valve to an upward position along the helical guide slot for the dispenser to deliver the product;

the upper valve being retractable relative to the flow-through gasket and the lower valve to a downward position along the helical guide slot to store the dispenser;

the lower valve and the flow-through gasket being rotatable in a spiral motion such that:

the at least one aperture of the lower valve, the at least one aperture of the flow-though gasket, and the at least one aperture of the upper valve are aligned for product delivery when the upper valve is rotated to the upper position; and the at least one aperture of the lower valve, the at least one aperture of the flow-through gasket, and the at least one aperture of the upper valve are not aligned for product delivery when the upper valve is retracted to the downward position; and an applicator coupled to the upper valve for applying the product.

25. The dispenser of claim 24, further comprising a cam path that slants upward to decompress the flow-through gasket when the upper valve is rotated in the spiral motion to the upward position to raise the applicator.

26. The dispenser of claim 24, further comprising a cam path that slants downward to compress the flow-through gasket when the upper valve is retracted in the spiral motion to the downward position to retract the applicator.

* * * * *